US009446828B1

(12) United States Patent
Groeschel et al.

(10) Patent No.: US 9,446,828 B1
(45) Date of Patent: Sep. 20, 2016

(54) MARINE VESSELS AND APPARATUSES FOR MOUNTING MARINE DRIVES ON MARINE VESSELS

(71) Applicant: Brunswick Corporation, Lake Forest, IL (US)

(72) Inventors: John A. Groeschel, Theresa, WI (US); David J. Waldvogel, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 152 days.

(21) Appl. No.: 14/267,441

(22) Filed: May 1, 2014

(51) Int. Cl.
*B63H 20/02* (2006.01)
*B63H 20/06* (2006.01)

(52) U.S. Cl.
CPC ..... *B63H 20/06* (2013.01); *B63H 2020/025* (2013.01)

(58) Field of Classification Search
USPC ..... 248/229.11, 229.21, 231.31, 640; 440/112, 52, 56
See application file for complete search history.

(56) References Cited

U.S. PATENT DOCUMENTS

| | | | | |
|---|---|---|---|---|
| 2,977,923 | A | 4/1961 | Bergstedt | |
| 3,136,287 | A | 6/1964 | North | |
| 3,376,842 | A | 4/1968 | Wynne | |
| 3,982,496 | A | 9/1976 | Blanchard | |
| 4,040,378 | A | 8/1977 | Blanchard | |
| 4,239,172 | A * | 12/1980 | Spitzmesser | B63H 20/08 248/641 |
| 4,482,330 | A * | 11/1984 | Cook | B63H 20/106 248/640 |
| 5,405,279 | A * | 4/1995 | Mastry | B63H 20/14 440/75 |
| 7,294,031 | B1 | 11/2007 | Davis et al. | |
| 7,690,959 | B1 * | 4/2010 | Szilagyi | B63B 3/70 440/112 |
| 7,867,046 | B1 * | 1/2011 | Eichinger | B63B 43/18 440/112 |
| 8,011,983 | B1 | 9/2011 | Davis et al. | |
| 8,821,140 | B2 * | 9/2014 | Paval | F04C 2/16 277/500 |
| 2004/0029463 | A1 * | 2/2004 | Brenner | B63H 23/321 440/112 |
| 2005/0272321 | A1 | 12/2005 | Mansson | |
| 2015/0060635 | A1 * | 3/2015 | Schlintz | B63H 20/02 248/640 |

* cited by examiner

*Primary Examiner* — Steven Marsh
(74) *Attorney, Agent, or Firm* — Andrus Intellectual Property Law, LLP

(57) ABSTRACT

An apparatus is for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member that is disposed between the inner and outer clamping plates. A first connector clamps the outer clamping plate to the outside surface of the hull and a second connector clamps the inner clamping plate to the outer clamping plate. The inner and outer clamping plates are held at a fixed distance from each other so that a consistent compression force is applied to the vibration dampening sealing member.

19 Claims, 5 Drawing Sheets

MARINE VESSELS AND APPARATUSES FOR MOUNTING MARINE DRIVES ON MARINE VESSELS

FIELD

The present disclosure relates to marine vessels and apparatuses for mounting marine drives to marine vessels.

BACKGROUND

The following U.S. Patents and Publications are incorporated herein by reference.

U.S. Pat. Nos. 2,977,923 and 3,136,287 disclose inboard-outboard mounting arrangements for marine drives.

U.S. Patent Publication No. 2005/0272321 discloses a boat hull with an outboard drive.

U.S. Pat. No. 7,294,031 discloses a marine vessel and drive combination that has upper and lower mounting plates that mount a marine propulsion device to a hull at an opening with a sealing grommet.

U.S. Pat. No. 8,011,983 discloses a marine drive that has a break-away mount mounting first and second sections of the drive and breaking-away in response to a given underwater impact against the second section to protect the first section and the vessel.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, apparatuses are for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member that is disposed between the inner and outer clamping plates. A first connector extends through the hull and clamps the outer clamping plate to the outside surface of the hull. A second connector extends through the hull and clamps the inner clamping plate to the outer clamping plate. The inner and outer clamping plates are held at a fixed distance from each other so that a consistent compression force is applied to the vibration dampening sealing member.

BRIEF DESCRIPTION OF THE DRAWINGS

Examples of a marine vessels and apparatuses for mounting marine drives to marine vessels are described with reference to the following Figures. The same numbers are used throughout the Figures to reference like features and like components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

Figure 1:
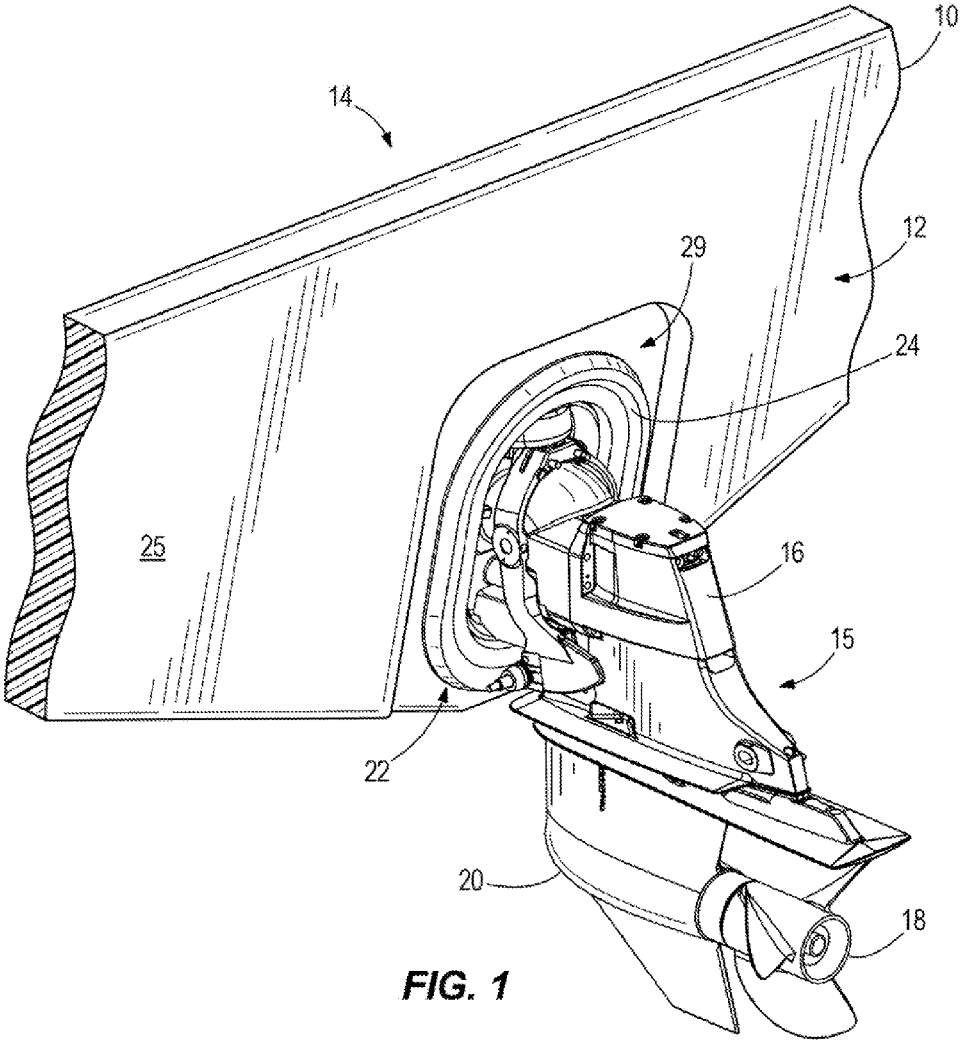
FIG. 1 is a perspective view of a marine drive mounted to a transom of a marine vessel.
Figure 2:
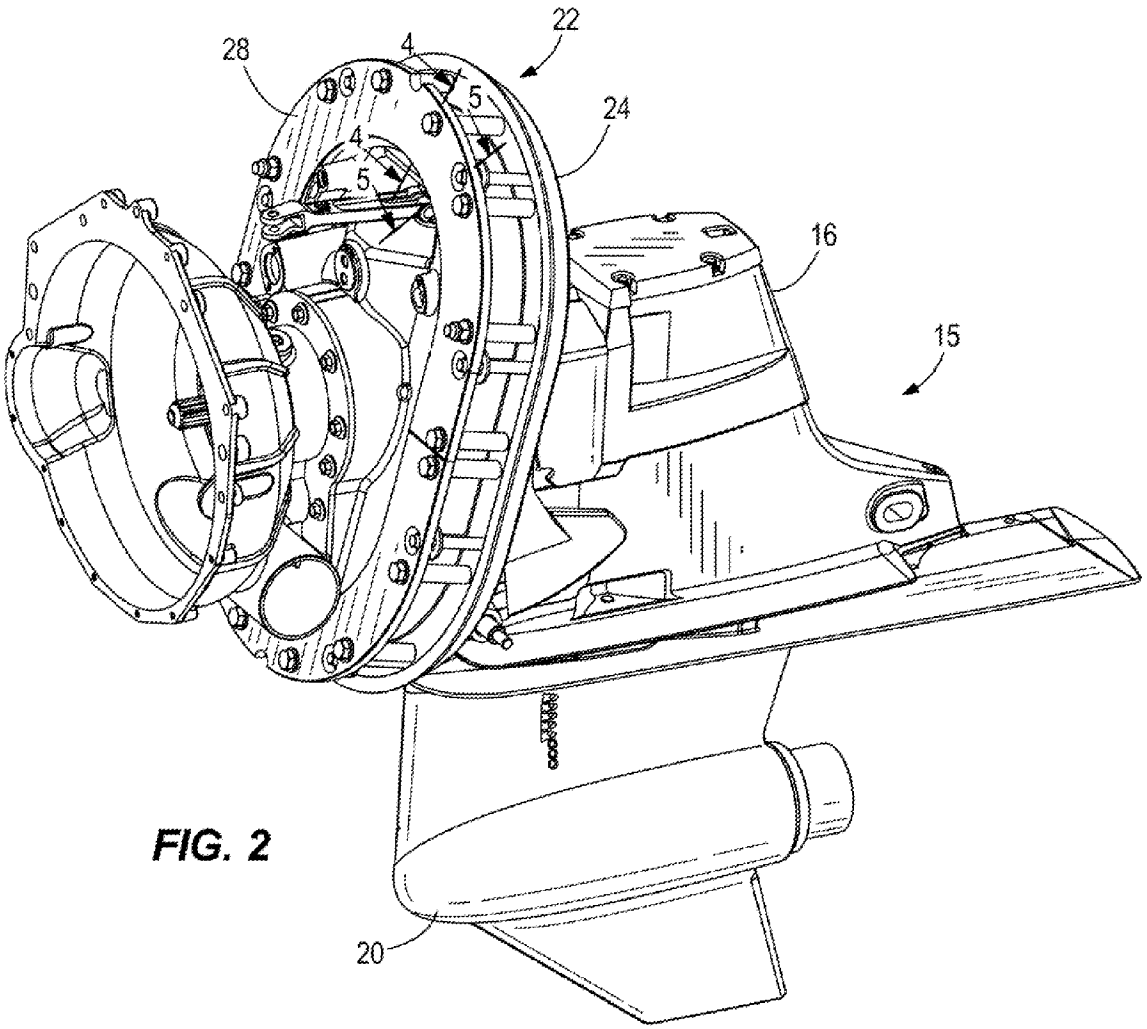
FIG. 2 is a perspective view of a housing of the marine drive and an apparatus for mounting the marine drive to the marine vessel.
Figure 3:
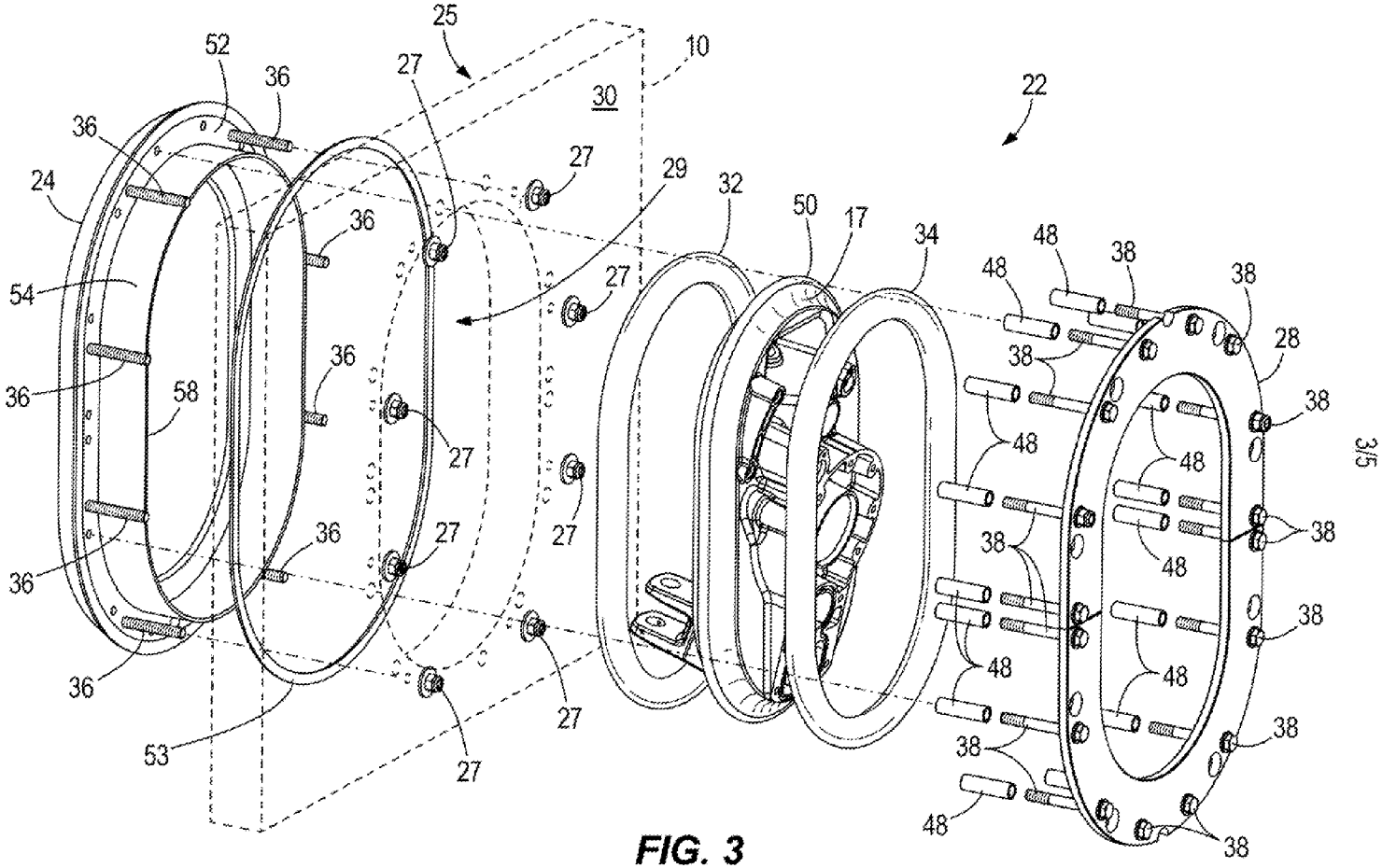
FIG. 3 is an exploded view of the apparatus for mounting the marine drive to the marine vessel.
Figure 4:
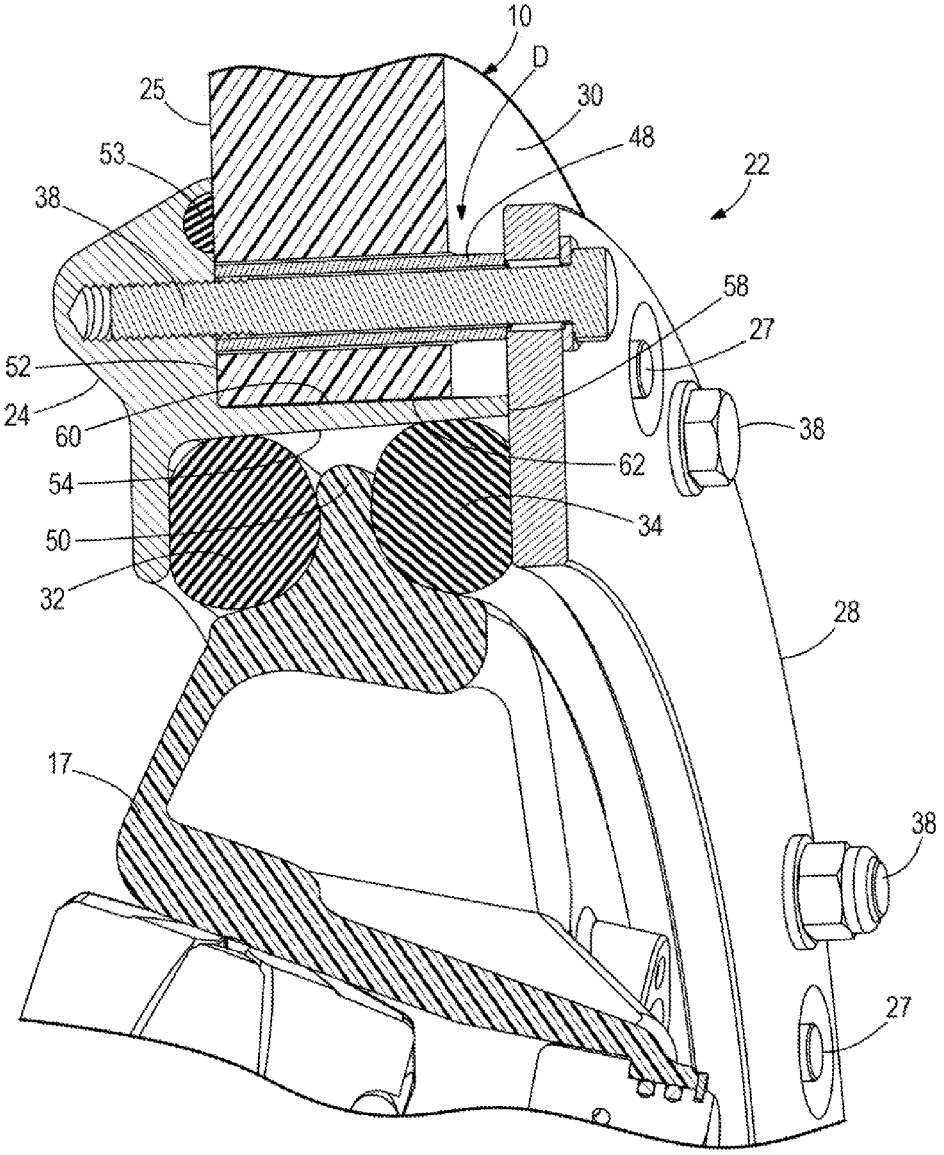
FIG. 4 is a section view of section 4-4 taken in FIG. 2.
Figure 5:
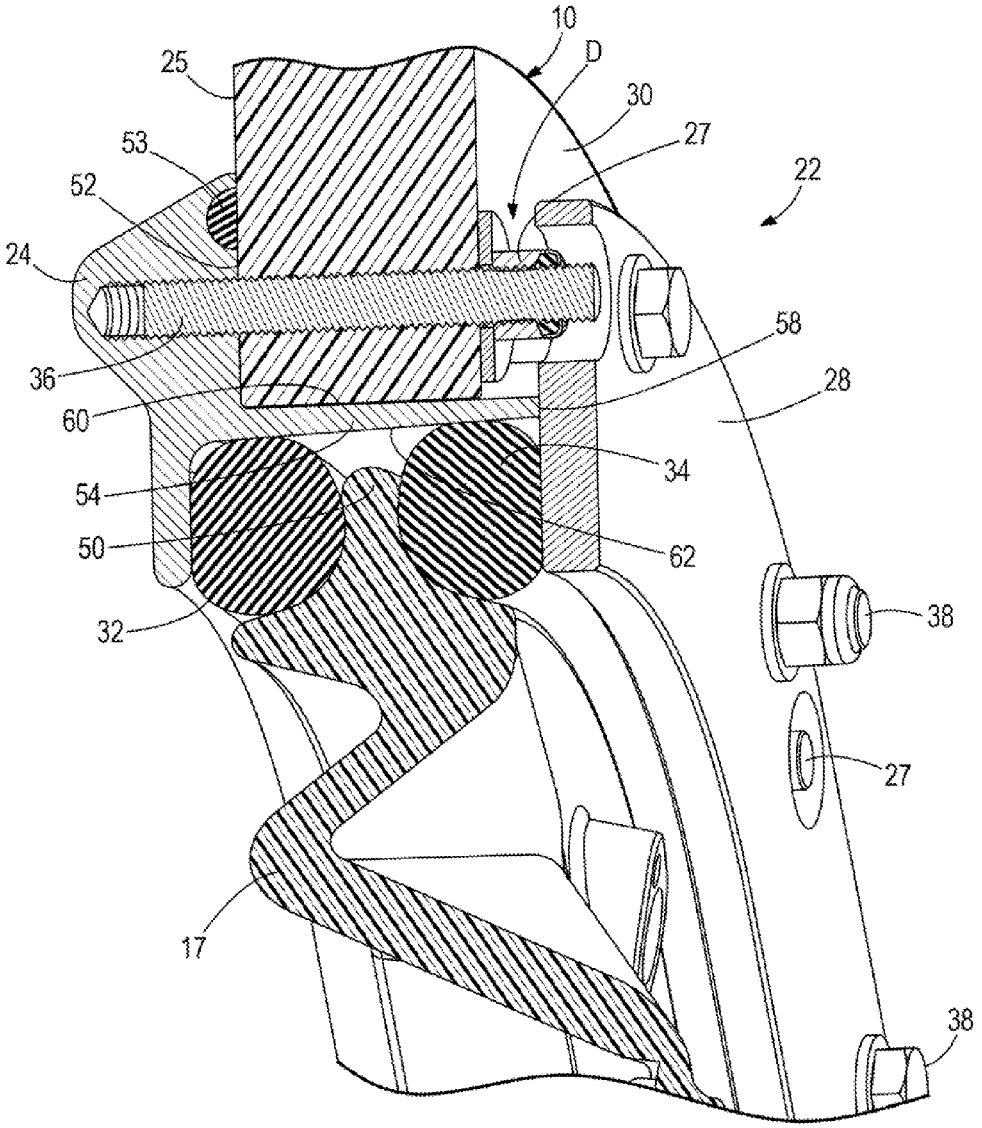
FIG. 5 is a section view of section 5-5 taken in FIG. 2.

FIG. 1 depicts a hull 10 located at a transom 12 of a marine vessel 14. A marine drive 15 is mounted to the transom 12 and includes a driveshaft housing 16 containing among other things a conventional driveshaft that is connected to an engine located in the marine vessel 14. Rotation of the driveshaft causes rotation of a propeller 18 via a transmission contained within the marine drive 15, as is common in the art. The marine drive 15 extends through an opening 29 in the hull 10 and is connected to the hull 10 by a mounting apparatus 22, which is a subject of the present disclosure and will be described further herein below with reference to FIGS. 2-5. For the purposes of discussion, a particular marine vessel and marine drive are shown in the figures; however it should be recognized that the present disclosure is not limited to this particular marine vessel and marine drive. That is, the concepts of the present disclosure can be applied to different marine vessels and marine drives then that shown.

As shown in FIGS. 2-5, the mounting apparatus 22 includes an outer clamping plate 24 that faces an outside surface 25 of the hull 10 and an inner clamping plate 28 that faces an opposing, inside surface 30 of the hull 10. A gimbal housing 17 of the marine drive 15 is located in the opening 29 in the hull 10 and is held in place with respect to the hull 10 by a pair of vibration dampening sealing members 32, 34. The vibration dampening sealing members 32, 34 are located on opposite sides, respectively, of the gimbal housing 17 and are sandwiched between the inner and outer clamping plates 28, 24. A plurality of first connectors 36 clamp the outer clamping plate 24 to the outside surface 25 of the hull 10. A plurality of second connectors 38 clamp the inner clamping plate 28 to the outer clamping plate 24. The type of connectors 36, 38 can vary from that which is shown. In this example, the plurality of first connectors 36 includes studs that clamp the outer clamping plate 24 against the outside surface 25 of the hull 10 when nuts 27 are screwed onto the ends of the studs. In this example, the plurality of second connectors 38 includes screws that force the inner clamping plate 28 toward the outer clamping plate 24 when the screws are screwed into the outer clamping plate 24. A plurality of spacers 48 are disposed on the plurality of second connectors 38 between the inner and outer clamping plates 28, 24. Each spacer 48 has a length that is equal to a fixed distance at which the inner and outer clamping plates 28, 24 are spaced from each other so that a consistent, predictable compression force is applied to the pair of vibration dampening sealing members 32, 34 by the inner and outer clamping plates 28, 24 when the first and second connectors 36, 38 are securely tightened. When the first and second connectors 36, 38 are securely tightened, the vibration dampening sealing members 32, 34 form a water-tight seal around an entirety of the housing 17, thus preventing passage of water through the opening 29 and also creating vibration isolation between the marine drive 15 and hull 10. The inner clamping plate 28 is held at a distance D from the inside surface 30 of the hull 10 (see FIGS. 4 and 5) by the spacers 48 to ensure clearance between the inner surface 30 and the clamping plate 28, so that the vibration dampening sealing members 32, 34 have a predictable amount of compression, and the inside surface 30 which can often be a rough and loosely controlled surface, does not affect this function.

In this example, the gimbal housing 17 has an outer perimeteral flange 50 that is disposed between the pair of vibration dampening sealing members 32, 34. The portion of the gimbal housing 17 having the outer perimeteral flange 50 can vary from that which is shown. The outer clamping plate 24 has an inner perimeteral surface 52 that faces the outside surface 25 of the hull 10 and a perimeteral rim 54 that extends transversely from the inner perimeteral surface 52 through the opening 19 in the hull 10. A sealing member 53 forms a seal between the outer clamping plate 24 and the outside surface 25 of the hull 10. The sealing member 53 extends around the gimbal housing 17 between the outer clamping plate 24 and the outside surface 25 of the hull 10. In this example, the sealing member 53 is an O-ring that provides a watertight seal between the outer clamping plate 24 and the hull 10. The type of seal can vary from that which is shown. The perimeteral rim 54 has a perimeteral edge 58 that abuts the inner clamping plate 28. The perimeteral rim 54 has a length that is equal to the above-mentioned fixed distance between the inner and outer clamping plates 28, 24. The perimeteral rim 54 thus has a length that is equal to the length of the plurality of spacers 48. The perimeteral rim 54 has an outer surface 60 that faces a radially inwardly facing perimeteral surface 62 of the hull 10, which defines the extent of the opening 19.

The marine drive 15 extends through the opening 19 in the hull 10 and the inner and outer clamping plates 28, 24 extend around an entire perimeter of the opening 19 on opposite sides of the opening 19, respectively. The vibration dampening sealing members 32, 34 also extend around the entire perimeter of the opening 19. In this example, the opening 19 is oval-shaped and the inner and outer clamping plates 28, 24 are oval-shaped. The shape of the opening 19 and plates 28, 24 can vary from that which is shown. The plurality of first connectors 36 and the plurality of second connectors 38 both extend through the hull 10. In use, vibrations on the marine drive 15 are transferred first through the vibration dampening sealing members 32, 34 and then to the inner and outer clamping plates 28, 24 and then to the hull 10.

The vibration dampening sealing members 32, 34 provide attachment of the marine drive 15 to the hull 10, as well as isolate the hull 10 from vibrations derived from the marine drive 15. Through experimentation, this has been found to provide excellent noise/vibration/harshness characteristics compared to the prior art. This also allows for easier installation of marine drives 15, particularly sterndrives as compared to the more complicated arrangements in the prior art.

Through research and experimentation, the present inventors have also realized that the hull section where a pod or sterndrive typically are attached to a marine vessel is often a fiberglass construction. The outside surface of the hull often is well-controlled, flat and smooth. The thickness is somewhat controlled, but not to a precision required for predicted sealing joints. The inside surface also often is not well-controlled. The thickness of the hull section can vary, which can cause clearance, assembly, and specifically, hull sealing issues in designs utilizing rubber sealing/isolating elements. In the examples provided herein above, the outer clamping plate is clamped directly onto the hull with fasteners designed to accommodate the noted anticipated thickness variation. The second set of fasteners are more precisely designed with bushings that are clamped to the outer clamping plate to thereby establish a more controlled distance between the inner and outer members. This eliminates the usage of the inside surface of the hull for establishing position of the inner clamping or structural member, thus providing an easier installation. Consistency of sealing and isolation capability is also provided. The dual clamping feature provides a hull thickness variation elimination feature, which is advantageous and allows design of a controlled sealing or isolating member into a variable thickness hull, without supplying any additional bolt or glass-in interface members to the marine vessel manufacturer. The examples thus provide highly simplified sealing and/or isolating by eliminating boat-builder tolerance from the analysis.

What is claimed is:

1. An apparatus for mounting a marine drive to a hull of a marine vessel, the apparatus comprising:

an outer clamping plate that is configured to face an outside surface of the hull and an inner clamping plate that is configured to face an opposing inside surface of the hull;

a marine drive housing that is configured to extend through the hull and be held in place with respect to the hull by at least one vibration dampening sealing member that is disposed between the inner and outer clamping plates;

a first connector that is configured to clamp the outer clamping plate to the outside surface of the hull and a second connector that clamps the inner clamping plate to the outer clamping plate;

wherein the inner and outer clamping plates are held at a fixed distance from each other so that a consistent compression force is applied to the vibration dampening member by the first and second clamping plates; and a spacer disposed on the second connector between the inner and outer clamping plates, the spacer maintaining the inner and outer clamping plates at the fixed distance from each other so that the consistent compression force is applied to the vibration dampening member.

2. The apparatus according to claim 1, wherein the inner clamping plate is configured to be spaced from the inside surface of the hull so that vibrations that act on the marine drive are transferred first through the vibration dampening sealing member and then to the inner and outer clamping plates and then to the hull.

3. The apparatus according to claim 1, wherein the first connector is one of a plurality of first connectors that are configured to clamp the outer clamping plate to the outside surface of the hull, the first connectors in the plurality of first connectors being spaced from each other around the outer clamping plate.

4. The apparatus according to claim 1, wherein the second connector is one of a plurality of second connectors that clamp the inner clamping plate to the outer clamping plate, the second connectors in the plurality of second connectors being spaced from each other around the inner and outer clamping plates.

5. The apparatus according to claim 1, comprising member that is configured to seal between the outer clamping plate and the outside surface of the hull, the sealing member extending around the marine drive housing between the outer clamping plate and the outside surface of the hull.

6. An apparatus for mounting a marine drive to a hull of a marine vessel, the apparatus comprising:

an outer clamping plate that is configured to face an outside surface of the hull and an inner clamping plate that is configured to face an opposing inside surface of the hull;

a marine drive housing that is configured to extend through the hull and be held in place with respect to the hull by at least one vibration dampening sealing member that is disposed between the inner and outer clamping plates; and a first connector that is configured to clamp the outer clamping plate to the outside surface of the hull and a second connector that clamps the inner clamping plate to the outer clamping plate;

wherein the inner and outer clamping plates are held at a fixed distance from each other so that a consistent compression force is applied to the vibration dampening member by the first and second clamping plates;

wherein the vibration dampening sealing member is one of a pair of vibration dampening sealing members that are disposed on opposite sides, respectively, of the marine drive housing and form a seal around an entirety of the marine drive housing; and wherein the marine drive housing comprises an outer perimeteral flange that is disposed between the pair of vibration dampening sealing members, wherein the pair of vibration dampening sealing members are disposed on opposite sides of the outer perimeteral flange.

7. The apparatus according to claim 6, wherein the pair of vibration dampening sealing members comprise O-rings.

8. The apparatus according to claim 1, wherein the first connector is a stud that is configured to clamp the outer clamping plate onto the outside surface of the hull and wherein the second connector is a screw that forces the inner clamping plate towards the outer clamping plate.

9. The apparatus according to claim 1, wherein the outer clamping plate comprises an inner perimeteral surface that is configured to face the outside surface of the hull and wherein the outer clamping plate further comprises a perimeteral rim that is configured to extend transversely from the inner perimeteral surface and through an opening in the hull.

10. An apparatus for mounting a marine drive to a hull of a marine vessel, the apparatus comprising:

an outer clamping plate that is configured to face an outside surface of the hull and an inner clamping plate that is configured to face an opposing inside surface of the hull;

a marine drive housing that is configured to extend through the hull and be held in place with respect to the hull by at least one vibration dampening sealing member that is disposed between the inner and outer clamping plates; and a first connector that is configured to clamp the outer clamping plate to the outside surface of the hull and a second connector that clamps the inner clamping plate to the outer clamping plate;

wherein the inner and outer clamping plates are held at a fixed distance from each other so that a consistent compression force is applied to the vibration dampening member by the first and second clamping plates;

wherein the outer clamping plate comprises an inner perimeteral surface that is configured to face the outside surface of the hull and further comprises a perimeteral rim that is configured to extend transversely from the inner perimeteral surface and through an opening in the hull; and wherein the perimeteral rim has an outer perimeteral edge that abuts the inner clamping plate.

11. The apparatus according to claim 10, wherein the perimeteral rim has a length that is equal to the fixed distance.

12. The apparatus according to claim 9, wherein the perimeteral rim has an outer surface that is configured to face a radially inwardly facing perimeteral surface of the opening of the hull.

13. A marine vessel comprising:

a marine drive that is mounted to a hull of a marine vessel by a mounting apparatus, the mounting apparatus comprising an outer clamping plate that faces an outside surface of the hull;

an inner clamping plate that faces an opposing inside surface of the hull;

a marine drive housing that extends through the hull, wherein the marine drive housing is held in place with respect to the hull by at least one vibration dampening member that is disposed between the inner and outer clamping plates;

a first connector that clamps the outer clamping plate to the outside surface of the hull;

a second connector that clamps the inner clamping plate to the outer clamping plate; and a spacer disposed on the second connector between the inner and outer clamping plates, the spacer maintaining the inner and outer clamping plates at a fixed distance from each other so that a uniform compression force is applied to the vibration dampening member by the first and second clamping plates.

14. The marine vessel according to claim 13, further comprising an opening in the hull; wherein the marine drive housing of the marine drive extends through the opening; wherein the inner and outer clamping plates extend around an entire perimeter of the opening on opposite sides of the opening, and wherein the vibration dampening sealing member extends around an entire perimeter of the opening.

15. The marine vessel according to claim 14, wherein the opening is formed in a transom of the marine vessel.

16. The marine vessel according to claim 15, wherein the opening is oval-shaped and wherein the inner and outer clamping plates are oval-shaped.

17. The marine vessel according to claim 13, wherein the first connector extends through the hull and wherein the second connector extends through the hull.

18. An apparatus for mounting a housing of a marine drive to a hull of a marine vessel, the apparatus comprising:

an outer clamping plate that is configured to face an outside surface of the hull and an inner clamping plate that is configured to face an opposing inside surface of the hull;

at least one vibration dampening sealing member that is disposed between the inner and outer clamping plates and configured to hold the marine housing in place with respect to the hull;

a first connector that is configured to clamp the outer clamping plate to the outside surface of the hull and a second connector that clamps the inner clamping plate to the outer clamping plate;

wherein the inner and outer clamping plates are held at a fixed distance from each other so that a consistent compression force is applied to the vibration dampening member by the first and second clamping plates; and a spacer disposed on the second connector between the inner and outer clamping plates, the spacer maintaining the inner and outer clamping plates at the fixed distance from each other so that the consistent compression force is applied to the vibration dampening member.

19. An apparatus for mounting a marine drive to a hull of a marine vessel, the apparatus comprising:

an outer clamping plate that is configured to face an outside surface of the hull and an inner clamping plate that is configured to face an opposing inside surface of the hull;

a marine drive housing that is configured to extend through the hull and be held in place with respect to the hull by at least one vibration dampening sealing member that is disposed between the inner and outer clamping plates; and a plurality of studs that is configured to clamp the outer clamping plate onto the outside surface of the hull; and a plurality of screws that clamps the inner clamping plate to the outer clamping plate and forces the inner clamping plate towards the outer clamping plate;

wherein the inner and outer clamping plates are held at a fixed distance from each other so that a consistent compression force is applied to the vibration dampening member by the first and second clamping plates;

wherein the plurality of studs is configured to extend through the outer clamping plate and the hull and wherein the plurality of screws is configured to extend through the inner clamping plate, the hull and the outer clamping plate; and wherein in use, the inner clamping plate is spaced from the inside surface of the hull so that vibrations that act on the marine drive are transferred first through the vibration dampening sealing member and then to the inner and outer clamping plates and then to the hull.

* * * * *